US009661710B1

(12) United States Patent
Zheng et al.

(10) Patent No.: US 9,661,710 B1
(45) Date of Patent: May 23, 2017

(54) DIMMER HOLDING CURRENT CONTROL CIRCUIT FOR PHASE CUT DIMMING POWER SUPPLY

(71) Applicant: Zhuhai Shengchang Electronics Co., Ltd., Zhuhai (CN)

(72) Inventors: Dehua Zheng, Zhuhai (CN); Xianyun Zhao, Zhuhai (CN)

(73) Assignee: ZHUHAI SHENGCHANG ELECTRONICS CO., LTD., Zhuhai (CN)

( * ) Notice: Subject to any disclaimer, the term of this patent is extended or adjusted under 35 U.S.C. 154(b) by 0 days.

(21) Appl. No.: 15/247,939

(22) Filed: Aug. 26, 2016

(30) Foreign Application Priority Data

Dec. 23, 2015 (CN) ..... 2015 2 1084823 U

(51) Int. Cl.
*H05B 33/08* (2006.01)
*H05B 37/02* (2006.01)

(52) U.S. Cl.
CPC ..... *H05B 33/0845* (2013.01); *H05B 37/02* (2013.01)

(58) Field of Classification Search
CPC ..... H05B 33/0845; H05B 37/02
USPC ..... 315/194
See application file for complete search history.

(56) References Cited

U.S. PATENT DOCUMENTS 9,609,713 * 3/2017 Zheng ..... H05B 33/0845
2012/0026716 A1* 2/2012 Bauer ..... H01L 23/495 361/820
2012/0262084 A1* 10/2012 Liu ..... H05B 33/0815 315/250
2013/0169177 A1* 7/2013 Liao ..... G05F 1/10 315/200 R

* cited by examiner

*Primary Examiner* — Dylan White
(74) *Attorney, Agent, or Firm* — Gokalp Bayramoglu

(57) ABSTRACT

The Invention discloses and provides a kind of dimmer holding current control circuit for phase cut dimming power supply, which comprises phase cut dimming power supply circuit and LED lamp (1) and dimmer holding current control circuit (2). The dimmer holding current control circuit (2) is composed of rectifier diode I (D1), rectifier diode II (D2), field-effect transistor (Q1), triode (Q2), current-limiting resistance I (R1), current-limiting resistance II (R2), sampling resistance I (R4), sampling resistance II (R5), diode (D3), capacitance (C1) and resistance (R3). The anodes of the rectifier diode I (D1) and the rectifier diode II (D2) are respectively connected to L terminal and N terminal of main supply input. The Invention makes the current small and stable through current limitation. The Invention can be widely used in the field of phase cut dimming power supply.

2 Claims, 1 Drawing Sheet

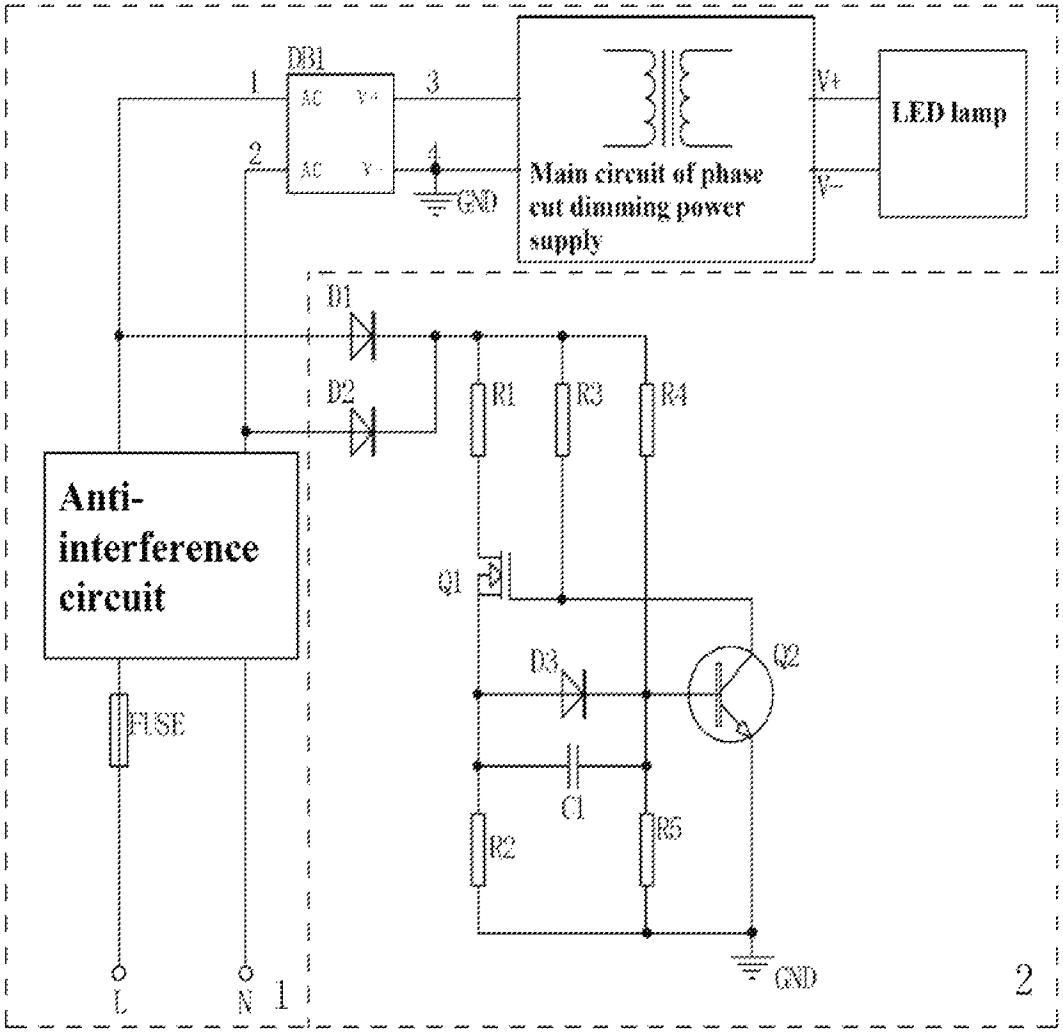
LED lamp
V+
V-
Main circuit of phase cut dimming power supply
GND
DB1
AC
AC
V+
V-
1
2
3
4
D1
D2
R1
R2
R3
R4
R5
Q1
Q2
D3
C1
GND
Anti-interference circuit
FUSE
N
L
1
2

DIMMER HOLDING CURRENT CONTROL CIRCUIT FOR PHASE CUT DIMMING POWER SUPPLY

FIELD OF THE INVENTION

The Invention relates to the field of phase cut dimming, and more particularly relates to a kind of control circuit of the cut phase (silicon controlled) dimming power supply to provide holding current to the phase cut dimmer.

BACKGROUND

In the application of the phase cut dimming power supply, in order to produce good dimming effect, it is necessary for the phase cut dimming power supply to provide the transistor in the phase cut dimmer with a current to maintain a conducting state. Such a current should be stable, but not excessive, as excessive current requires more power consumption and reduces the overall conversion efficiency of the power supply.

At present, what is used most is to connect an X capacitance (or thin-film capacitor) and a bleeder resistance to the input terminal of the power supply or connect an X capacitance (or thin-film capacitor) and then serial in a DM (differential mode) inductor in the front of such an X capacitance, to provide holding current for the dimmer. Such a method has great power consumption in the bleeder resistance and DM inductor and great heat radiation. The use of such a circuit has a very low efficiency. Moreover, as the temperature of the bleeder resistance and DM inductor increases greatly, it will also affect the reliability of the whole machine. It is also more difficult to control and adjust the size of the holding current with such a method. Meanwhile, it is very easy to make the dimmer vibrate, resulting in noises.

To sum up, in the existing technologies, the phase cut dimmer holding current control circuit has a high power consumption, high temperature rise and is hard to adjust but prone to cause noise in the dimmer among other defects.

SUMMARY OF THE INVENTION

The technical problem to be solved by the Invention is to overcome the drawbacks of the prior art and to provide a phase cut dimmer holding current control circuit, which has a small power consumption, low heat radiation, is easy to adjust, has high reliability, is not easy to cause noise in the front phase cut (leading edge) and rear phase cut (lagging edge) dimmer.

The technical solution of the Invention is: the Invention comprises phase cut dimming power supply circuit and LED lamp and dimmer holding current control circuit. The phase cut dimming power supply circuit and LED lamp is composed of anti-interference circuit, bridge rectifier, main circuit of phase cut dimming power supply and LED lamp, which are connected in turn. The anti-interference circuit is connected to L terminal and N terminal of main supply through a fuse. The dimmer holding current control circuit is composed of rectifier diode I, rectifier diode II, field-effect transistor, triode, current-limiting resistance I, current-limiting resistance II, sampling resistance I, sampling resistance II diode, capacitance and resistance. The anodes of the rectifier diode I and the rectifier diode II are respectively connected to L terminal and N terminal of main supply input of the phase cut dimming power supply. The cathode of the rectifier diode I and the cathode of the rectifier diode II are connected to each other and to one end of the current-limiting resistance I, one end of the sampling resistance I and one end of the resistance. The other end of the current-limiting resistance I is connected to the drain electrode of the field-effect transistor. The other end of the resistance is connected to the grid electrode of the field-effect transistor and the collector of the triode. The other end of the sampling resistance I is connected to the base of the triode, the cathode of the diode, one end of the capacitance and one end of the sampling resistance II. The source electrode of the field-effect transistor is connected to the anode of the diode, the other end of the capacitance and one end of the current-limiting resistance II. The other end of the sampling resistance II, the other end of the current-limiting resistance II and the emitter of the triode are connected to the circuit common ground.

The anodes of the rectifier diode I and the rectifier diode II are respectively connected to L terminal and N terminal of main supply input of the phase cut dimming power supply. The L terminal and N terminal of main supply input are two points for the output terminal of the anti-interference circuit connecting to the input terminal of the bridge rectifier. The circuit common ground is the cathode of the DC output terminal of the bridge rectifier.

The beneficial effects of the Invention are: the Invention comprises rectifier diode I, rectifier diode II, field-effect transistor, triode, current-limiting resistance I, current-limiting resistance II, sampling resistance I, sampling resistance II, diode, capacitance and resistance. The anodes of the rectifier diode I and the rectifier diode II are respectively connected to L terminal and N terminal of main supply input of the phase cut dimming power supply. The cathode of the rectifier diode I and the cathode of the rectifier diode II are connected to each other and to one end of the current-limiting resistance I, one end of the sampling resistance I and one end of the resistance. The other end of the current-limiting resistance I is connected to the drain electrode of the field-effect transistor. The other end of the resistance is connected to the grid electrode of the field-effect transistor and the collector of the triode. The other end of the sampling resistance I is connected to the base of the triode, the cathode of the diode, one end of the capacitance and one end of the sampling resistance II. The source electrode of the field-effect transistor is connected to the anode of the diode, the other end of the capacitance and one end of the current-limiting resistance II. The other end of the sampling resistance IL, the other end of the current-limiting resistance II and the emitter of the triode are connected to the circuit common ground. The L terminal and N terminal of main supply input are two points for the output terminal of the anti-interference circuit connecting to the input terminal of the bridge rectifier. The circuit common ground is the cathode of the DC output terminal of the bridge rectifier. The Invention makes its working current small through current limitation. And such a current can also steadily maintain the normal operation of the phase cut dimmer which connects to the phase cut dimming power supply. Therefore, the Invention is a phase cut dimmer holding current control circuit with simple circuit, low cost, low heat radiation and high reliability and being easy to adjust.

BRIEF DESCRIPTION OF THE DRAWINGS

FIG. 1 is a circuit schematic diagram of the Invention.

DETAILED DESCRIPTION OF THE EMBODIMENT

As shown in FIG. 1, the invention comprises phase cut dimming power supply circuit and LED lamp 1 and dimmer holding current control circuit 2. The phase cut dimming power supply circuit and LED lamp 1 is composed of an anti-interference circuit, a bridge rectifier, a main circuit of the phase cut dimming power supply and LED lamp, which are connected in turn. The anti-interference circuit is connected to L terminal and N terminal of main supply through a fuse. Dimmer holding current control circuit 2 is composed of rectifier diode I D1, rectifier diode II D2, field-effect transistor Q1, triode Q2, current-limiting resistance I R1, current-limiting resistance II R2, sampling resistance I R4, sampling resistance II R5, diode D3, capacitance C1 and resistance R3. The anodes of rectifier diode I D1 and rectifier diode II D2 are respectively connected to L terminal and N terminal of main supply input of the phase cut dimming power supply. The cathode of rectifier diode I D1 and the cathode of rectifier diode II D2 are connected to each other and to one end of current-limiting resistance I R1, one end of sampling resistance I R4 and one end of resistance R3. The other end of current-limiting resistance I R1 is connected to the drain electrode of field-effect transistor Q1. The other end of resistance R3 is connected to the grid electrode of field-effect transistor Q1 and the collector of triode Q2. The other end of sampling resistance I R4 is connected to the base of triode Q2, the cathode of diode D3, one end of capacitance C1 and one end of sampling resistance II R5. The source electrode of field-effect transistor Q1 is connected to the anode of diode D3, the other end of capacitance C1 and one end of current-limiting resistance II R2. The other end of sampling resistance II R5, the other end of current-limiting resistance II R2 and the emitter of triode Q2 are connected to circuit common ground GND.

The anodes of rectifier diode I D1 and rectifier diode II D2 are respectively connected to L terminal and N terminal of main supply input of the phase cut dimming power supply. The L terminal and N terminal of main supply input are two points for the output terminal of the anti-interference circuit connecting to the input terminal of the bridge rectifier. Circuit common ground GND is the cathode of the DC output terminal of the bridge rectifier.

In some embodiments, rectifier diode I D1 and rectifier diode II D2 may be alternated with a bridge rectifier circuit, the cathode of which is circuit common ground GND.

In the Embodiment, the sine-wave voltage of the main supply is rectified into a full-wave voltage through rectifier diodes D1 and D2. Such a voltage provides a driving voltage for the grid electrode of field-effect transistor Q1 through resistance R3. Therefore, field-effect transistor Q1 is conducted. The full-wave voltage obtained from rectification in rectifier diodes D1 and D2 passes through current-limiting resistance R1, field-effect transistor Q1, current-limiting resistance R2 and GND, and then returns to the input terminal of the main supply through bridge rectifier DB1 of the phase cut dimming power supply, forming a loop. Wherein, a current is also generated. Such a current is the holding current that maintains the normal conduction of the phase cut dimmer in the front of the input terminal of the phase cut dimming power supply. Moreover, such a current will generate a pressure drop when passing through the current-limiting resistance R2. When the pressure drop reaches a certain value, such a pressure drop will be added to the base of triode Q2 through diode D3, then Q2 is conducted. Therefore, field-effect transistor Q1 will be shut off. And due to the shut-off of field-effect transistor Q1, the current passing through the current-limiting resistance R2 falls, and the pressure drop in current-limiting resistance R2 is also reduced. Subsequently, triode Q2 is cut off and then resumed and conducted, and so on. The current passing through current-limiting resistance R2, field-effect transistor Q1 and current-limiting resistance R1 will be limited to a relatively stable value, which equals to that the Invention forms a more stable current loop. Such a current loop will provide the phase cut dimmer with a more stable holding current. In addition, the full-wave voltage obtained from rectification in rectifier diodes D1 and D2 is divided through sampling resistance R4 and R5. As both ends of sampling resistance R5 are connected to the base and the emitter of triode Q2, when the voltage in sampling resistance R5 reaches the voltage for the conduction of triode Q2, triode Q2 is conducted and field-effect transistor Q1 is cut off. Therefore, when the full-wave voltage obtained from rectification in rectifier diodes D1 and D2 is within a relatively high voltage range, field-effect transistor Q1 will not be conducted, and there will be no current generated in the loop. And within such a range of voltage, the current consumed by the phase cut dimming power supply can maintain the conduction of the phase cut dimmer. Therefore, the Invention has a low power consumption and low heat radiation. So, the Invention is a phase cut dimmer holding current control circuit with simple circuit, low cost, low heat radiation and high reliability and easy adjustment.

The Invention can be widely used in the field of phase cut dimming power supply.

The invention claimed is:

1. A dimmer holding current control circuit for phase cut dimming power supply, comprises a phase cut dimming power supply circuit and a LED lamp and a dimmer holding current control circuit; the phase cut dimming power supply circuit and the LED lamp is composed of an anti-interference circuit, a bridge rectifier, a main circuit of phase cut dimming power supply and LED lamp, which are connected in turn; the anti-interference circuit is connected to L terminal and N terminal of main supply through a fuse; wherein the dimmer holding current control circuit is composed of a rectifier diode I, a rectifier diode II, a field-effect transistor, a triode, a current-limiting resistance I, a current-limiting resistance II, a sampling resistance I, a sampling resistance II, a diode, a capacitance and resistance; the anodes of the rectifier diode I and the rectifier diode II are respectively connected to L terminal and N terminal of main supply input of the phase cut dimming power supply; the cathode of the rectifier diode I and the cathode of the rectifier diode II are connected to each other and to one end of the current-limiting resistance I, one end of the sampling resistance I and one end of the resistance; the other end of the current-limiting resistance I is connected to the drain electrode of the field-effect transistor; the other end of the resistance is connected to the grid electrode of the field-effect transistor and the collector of the triode; the other end of the sampling resistance I is connected to the base of the triode, the cathode of the diode, one end of the capacitance and one end of the sampling resistance II; the source electrode of the field-effect transistor is connected to the anode of the diode, the other end of the capacitance and one end of the current-limiting resistance II; the other end of the sampling resistance II, the other end of the current-limiting resistance II and the emitter of the triode are connected to the circuit common ground.

2. The dimmer holding current control circuit for phase cut dimming power supply according to claim 1, wherein the anodes of the rectifier diode I and the rectifier diode II are respectively connected to L terminal and N terminal of main supply input of the phase cut dimming power supply; the L terminal and N terminal of main supply input are two points for the output terminal of the anti-interference circuit connecting to the input terminal of the bridge rectifier; the circuit common ground is the cathode of the DC output terminal of the bridge rectifier.

* * * * *